United States Patent [19]

Yamataka et al.

[11] Patent Number: 4,525,251

[45] Date of Patent: Jun. 25, 1985

[54] PROCESS FOR PRODUCING DIMETHYL ESTERS OF HIGHER DIBASIC ACID

[75] Inventors: Kazunori Yamataka; Toshiro Isoya, both of Nobeoka, Japan

[73] Assignee: Asahi Kasei Kogyo Kabushiki Kaisha, Osaka, Japan

[21] Appl. No.: 536,160

[22] PCT Filed: Nov. 26, 1982

[86] PCT No.: PCT/JP82/00451

§ 371 Date: Sep. 12, 1983

§ 102(e) Date: Sep. 12, 1983

[87] PCT Pub. No.: WO83/02463

PCT Pub. Date: Jul. 21, 1983

[30] Foreign Application Priority Data

| | | | |
|---|---|---|---|
| May 28, 1981 | [JP] | Japan | 56-80016 |
| Jun. 4, 1981 | [JP] | Japan | 56-85017 |
| Jan. 12, 1982 | [JP] | Japan | 57-2261 |
| Aug. 27, 1982 | [JP] | Japan | 57-147810 |

[51] Int. Cl.[3] ..... C07B 29/06

[52] U.S. Cl. ..... 204/79; 204/59 R; 204/72

[58] Field of Search ..... 204/59 R, 72, 79

[56] References Cited

U.S. PATENT DOCUMENTS

| | | | |
|---|---|---|---|
| 3,879,271 | 4/1975 | Nohe | 204/59 R |
| 3,896,011 | 7/1975 | Isoya | 204/59 R |
| 4,237,317 | 12/1980 | Yamataka | 204/59 R |

OTHER PUBLICATIONS

Chemical Abstracts, vol. 66, 1967, p. 4095, Abstract No. 43109x.

Chemical Abstracts, vol. 74, 1971, p. 295, Abstract No. 52994z.

Oil Chemistry, vol. 12, p. 669, (1963).

Y. B. Vassiliev et al., Electrochimica Acta, 27(7), 953–962 and 937–952, (1982).

*Primary Examiner*—John F. Niebling

*Attorney, Agent, or Firm*—Armstrong, Nikaido, Marmelstein & Kubovcik

[57] ABSTRACT

Dimethyl ester of a higher dibasic acid, such as dimethyl sebacate, dimethyl brassylate or dimethyl thapsate, can be produced by a batchwise electrolytic condensation of a mixture of acid esters consisting of 2 moles or more of monomethyl adipate or monomethyl glutarate essentially free of glutaric acid and essentially free of glutaric anhydride, for each 1 mole of monomethyl ester of a $C_8$–$C_{11}$ dicarboxylic acid, in methanol in which 0.15–3.5% by weight of water is kept during the electrolic condensation, the mixture of acid esters being partially neutralized with alkali metal.

10 Claims, 2 Drawing Figures

PROCESS FOR PRODUCING DIMETHYL ESTERS OF HIGHER DIBASIC ACID

TECHNICAL FIELD

This invention relates to a novel process for industrial production of dimethyl esters of higher dibasic acids and more particularly, to a process for producing dimethyl esters of higher dibasic acids by the crossed Kolbe electrolytic condensation of monomethyl adipate or monomethyl glutarate with the monomethyl ester of a $C_8$–$C_{11}$ dicarboxylic acid.

BACKGROUND ART

Dimethyl esters of higher dibasic acids have very expanded use as raw materials for perfumes, various polymers, plasticizers, and so forth. In particular, dimethyl brassylate, dimethyl pentadecanedioate, and dimethyl thapsate are exceedingly useful as raw materials for producing ethylene brassylate, cyclopentadecanone and the like, which are very important as musk perfumes.

Processes now practiced and those so far proposed for producing higher dibasic acids and their esters are illustrated by the following examples pertaining to brassylic acid, pentadecanedioic acid, thapsic acid, and their esters.

Brassylic acid and esters thereof are produced by oxidizing erucic acid which is contained in rapeseed oil, with ozone or permanganic acid. This method, however, involves problems such as low yields of the oxidation, formation of various compounds by the reaction, troublesome purification of the intended product, and low purity of the product.

In addition, the following processes have been proposed for synthesizing brassylic acid: a process in which diethyl malonate is reacted with methyl undecylenate to be added thereto using di-tertbutyl peroxide, and the product is then hydrolyzed [Kirkiacharian, Berdj, Bull. Soc. Chim. Fr., (5), 1797 (1971)]; a process in which ethyl 11-bromoundecanoate and ethyl cyanoacetate are reacted by heating in dimethylformamide, and the product is decarboxylated after its hydrolysis [Dudinov, A. A., Izv. Akad. Nauk, SSSR, Ser, Khim, 1974(6), 1421–1423]; a process in which 2-ethoxycarbonylcyclododecanone and sodium hydroxide are heated in diethylene glycol and the reaction mixture is then acidified (Japanese Patent Publication No. 34,406/71); and a process in which 2,2′-methylenebis(cyclohexanone) is converted into 6,6-methylenebis(6-hexanolide) by reacting with a peroxy acid in a halogenated organic solvent in the presence of an alkali carbonate, and the product is heated with pressurized hydrogen in alcohol in the presence of metallic catalyst and an acid catalyst (Japanese Patent Application Kokai No. 113,741/80). However, these processes are not always satisfactory as industrial processes because raw materials are difficult to obtain or an expensive and hazardous peroxide is necessary to the reaction.

As to pentadecanedioic acid and esters thereof, various production processes have so far been proposed. For example, there are proposed the following processes: a process in which a dioxo ester is obtained from monomethyl glutarate acid chloride and a cadmium compound prepared from $\alpha$, $\omega$-dibromopentane, and is subjected, after saponification, to the Wolff-Kishner reduction [A. Kreuchunas, J.A.C.S., 75, 3339(1953)]; a process in which ustilic acid obtained by the hydrolysis of ustilagic acid in methanol with alkali is treated with lead tetraacetate in glacial acetic acid, and the resulting aldehyde acid is oxidized with hydrogen peroxide in an aqueous alkali solution (U.S. Pat. No. 2,717,266); a process in which diethyl undecyleneylmalonate is obtained from undecylenic acid by a known method and reacted in toluene to add hydrogen bromide, the resulting diethyl 11-bromoundecyl malonate is reacted with diethyl malonate in the presence of sodium alcoholate, and the product is hydrolyzed and decarboxylated (Japanese Patent Publication No. 10,322/57); a process in which ethyl 15,16-dihydroxylignocerate is oxidized with sodium periodate and the resulting $\omega$-oxotridecane-1-carboxylic acid is oxidized with potassium permanganate in acetone (German Patent No. 1,187,600); and a process in which aleuritic acid is treated with hydrogen bromide in acetic acid, the resulting 9,10,16-tribromopalmitic acid is converted into its methyl ester, which is then treated with zinc dust in methanol, the resulting methyl $\omega$-bromohexadecenoate is treated in a solution of sodium acetate in acetic acid and reduced and saponified, and the resulting $\omega$-hydroxypalmitic acid is oxidized (Indian Pat. No. 65,543). However, any of these processes cannot be said to be satisfactory in industrial production since it has problems such that too many reaction steps are required, a special reagent is used, or yields are low.

As to methods for producing diesters of thapsic acid, the following processes, for example, have been proposed; a process comprising the ring-opening dimerization of cyclohexanone with Fenton's reagent in the presence of butadiene (a half-monthly magazine "Fine Chemical", No. Aug. 1, 1978, issued by C.M.C. Co., Ltd.); a process comprising an electrolytic condensation of a monoester of azelaic acid [Japanese Patent Publication No. 11,116/63; Kovsaman, E. P., Fraidlin, G. N., and Tarkkamov, G. A., (USSR), Electrosint. Monomerov, 49-73(1980)]. The former process using Fenton's reagent problems due to various products being formed and the main product not being the desired product, and cannot be said to be satisfactory in industrial production. The latter electrolytic condensation process, according to the reference cited above, is considered to have problems due to the electrolytic apparatus being complicated and the current efficiency being low, since it is described in this reference that the cell needs to be separated by an ion exchange membrane into anode and cathode compartments and the water concentration in the anolyte is 30–40% by weight. In the latter reference, there is described a polymer-like film sparingly soluble in water and in methnol which formed on the anode, became thicker with the progress of electrolysis, and was observed even with the naked eye. In any case, the process for electrolytic condensation of such monoesters of dicarboxylic acids of large number of carbon atoms, having still many problems, cannot be said to be satisfactory in industrial production.

In addition, various fermentation processes have been proposed recently for converting n-alkanes or monocarboxylic acids into dibasic acids by use of yeast. However, these fermentation processes, poor in yield, also cannot yet be said to be satisfactory as industrial processes.

DISCLOSURE OF THE INVENTION

In view of the above circumstances, the present inventors conducted intensive studies for the purpose of providing an industrially advantageous process for producing diesters of higher dibasic acids which would solve the various problems involved in the various processes hitherto proposed for producing said diesters. As a result, it has become possible to carry out the electrolytic condensation until the content of a monomethyl ester of a $C_8$–$C_{11}$ dicarboxylic acid in the electrolyte decreases to 1% or less by weight while keeping the current efficiency and the selectivity at high levels, by selecting monomethyl adipate which has a relatively small number of carbon atoms, and a monomethyl ester of a $C_8$–$C_{11}$ dicarboxylic acid for batchwise crossed Kolbe electrolytic condensation in a molar ratio of the former ester to the latter of at least 2:1. Thus, very effective industrial production of dimethyl esters of higher dibasic acids has become possible. Further, when monomethyl glutarate is used as the monomethyl ester of dicarboxylic acid of small number of carbon atoms, the same effects as in the case of monomethyl adipate can be obtained by the batchwise crossed Kolbe electrolytic condensation using a ratio of 2 moles or more of monomethyl glutarate mole of the monomethyl ester of a $C_8$–$C_{11}$ dicarboxylic acid, provided that this monomethyl glutarate used is produced from glutaric anhydride and methanol, and contains essentially to glutaric anhydride or glutaric acid.

Thus, this invention is characterized in that a mixture of acid esters consisting of monomethyl adipate and a monomethyl ester of a $C_8$–$C_{11}$ dicarboxylic acid is electrolytically condensed batchwise in a methanolic solution containing the alkali salts of both acid esters, at a molar ratio of at least 2 of monomethyl adipate to the monomethyl ester of a $C_8$–$C_{11}$ dicarboxylic acid, while keeping the water concentration in the methanolic solution at 0.15–3.5% by weight; or in that electrolytic condensation is carried out using a mixture of monomethyl glutarate essentially free of glutaric anhydride and essentially free of glutaric acid, and a monomethyl ester of a $C_8$–$C_{11}$ dicarboxylic acid, in the same manner as in the case where monomethyl adipate is used.

The electrolytic condensation reaction of this invention can be considered as follows. One would expect that diesters of various higher dibasic acids are obtained, as stated in reference to processes for producing a diester of thapsic acid, by the crossed Kolbe electrolytic condensation of a monoester of a dicarboxylic acid having a relatively large number of carbon atoms or by the crossed Kolbe electrolytic condensation of monoesters of various dicarboxylic acids. It has been stated above, however, that many problems are involved in the hitherto proposed processes for the electrolytic condensation of a monoester of dicarboxylic acid having a relatively large number of carbon atoms. Formerly, the present inventors disclosed detailed industrial operational techniques on a process for producing dimethyl sebacate from monomethyl adipate, which has a relatively small number of carbon atoms, in Japanese Patent Application Kokai Nos. 152672/79, 158285/80, and 44782/81. Comparative Example 4 herein shows results from an application of these techniques to monomethyl azelate, which has a relatively large number of carbon atoms. Reviewing these results reveals problems in that the voltage is high, both the yield and current efficiency are poor, and much unreacted monomethyl azelate remains. Additionally a thin polymer-like film is observed to a slight extent on the anode surface. Thus, it would be questionable to apply simply the techniques formerly proposed by the present inventors to the production of dimethyl esters of higher discarboxylic acids. The same can also be said with respect to the crossed Kolbe electrolytic condensation of monoesters of dissimilar dicarboxylic acids having a relatively large number of carbon atoms. Although the cause is not clear, one possible factor is the adhesion of polymer-like matter to the anode surface. This adhesion of polymer-like matter can be markedly reduced with this invention. While this reduction of the adhered polymer-like matter may be attributed to prevention of the formation of the polymer-like matter, it is actually due to the dissolving of the polymer-like matter. It has been confirmed by the present inventors that monomethyl esters of dicarboxylic acids of a small number of carbon atoms, in particular monomethyl adipate or monomethyl glutarate which is essentially free of either glutaric anhydride or glutaric acid, has the action of dissolving partly the polymer-like matter formed.

The primary feature of this invention is that a monoester of dicarboxylic acid of a small number of carbon atoms, in particular monomethyl adipate or monomethyl glutarate which is essentially free of either glutaric anhydride or glutaric acid, is chosen as one of the monoesters of dicarboxylic acids to be subjected to the crossed Kolbe electrolytic condensation. The monomethyl adipate can be produced by a common process, that is, by the monomethylation of adipic acid; however, if monomethyl glutarate is produced by such a common process and used in the crossed Kolbe electrolysis, results of the electrolysis may be poorer as shown in Comparative Example 11, than in the case of the single Kolbe electrolysis of a monomethyl ester of dicarboxylic acid having a large number of carbon atoms. A cause of this is considered to be as follows: when monomethyl glutarate is separated by distillation from a three-component system containing glutaric acid, monomethyl glutarate, and dimethyl glutarate, some of the glutaric acid remaining in distillation bottoms is dehydrated to form glutaric anhydride; this glutaric anhydride is distilled off along with water during distillation, and hence the distilled monomethyl glutarate is contaminated with the glutaric acid produced by the reaction of glutaric anhydride and water. Also, monomethyl glutarate containing some glutaric anhydride and glutaric acid cannot be thoroughly purified by redistillation, and therefore some contamination of monomethyl glutarate with glutaric anhydride or with glutaric acid is inevitable. These contaminants may exert unfavorable influences on the electrolytic condensation. Accordingly, it is necessary to adopt a special process for the purpose of producing monomethyl glutarate essentially uncontaminated with either glutaric anhydride nor glutaric acid. That is to say, the production of monomethyl glutarate containing neither glutaric anhydride or glutaric acid is impossible, unless glutaric acid is once dehydrated by heating to be converted into glutaric anhydride, which is then reacted with methanol to produce monomethyl glutarate.

Another feature of this invention is the use of two moles or more of monomethyl adipate or monomethyl glutarate per mole of the monomethyl ester of a $C_8$–$C_{11}$ dicarboxylic acid. The electrolytic condensation of this invention is much affected by the molar ratio of monomethyl adipate or monomethyl glutarate to the monomethyl ester of a $C_8$–$C_{11}$ dicarboxylic acid. Tables 1 and 3 show results of batchwise electrolytic condensations conducted at various ratios of monomethyl adipate to monomethyl azelate or to monomethyl undecanedioate until the monomethyl adipate concentration in the electrolyte decreases to 0.1% by weight or less. The following remarks can be made from these results when a monomethyl ester of a $C_8$–$C_{11}$ dicarboxylic acid is used in a proportion of one mole or more to monomethyl adipate, the batchwise electrolysis, even if continued until the monomethyl adipate concentration in the electrolyte is reduced to 0.1% by weight or less, still leaves a considerable amount of the monomethyl ester of a $C_8$–$C_{11}$ dicarboxylic acid in the electrolyte as shown in Comparative Examples 1–3 and 8–9. Though the selectivity is not so low, the current efficiency is rather low and the average cell voltage is considerably high. Moreover, when the concentration of the the monomethyl ester of $C_8$–$C_{11}$ dicarboxylic acid remaining in the electrolyte is reduced by further continuing the electrolysis, the cell voltage rapidly rises more, the current efficiency also decreases more, and even the selectivity falls, as shown in Comparative Examples 5 and 10. If the electrolysis is stopped, in order to avoid the problems described above, with a considerable amount of the dimethyl ester of the $C_8$–$C_{11}$ dicarboxylic acid still remaining in the electrolyte, most of the advantages of the batchwise electrolytic method will be lost. Thus, this makes it necessary to separate the monomethyl ester of the $C_8$–$C_{11}$ dicarboxylic acid in the purification step, and complicates the apparatus for the separation because of the extreme difficulty of the distillation and separation of the product, dimethyl esters of higher dibasic acids. Further, problems will arise such as a partial loss of monomethyl dicarboxylates during the separation and insufficient separation of the monomethyl dicarboxylates, which lowers the purity of the product, dimethyl esters of higher dibasic acids. On the contrary, when monomethyl adipate is used in a ratio of two moles or more per mole of the monomethyl ester of the $C_8$–$C_{11}$ dicarboxylic acid, these problems are solved to a great extent. Further, when monomethyl adipate is used in a ratio of 5 moles or more, the problems are solved to nearly the same extent as in the electrolysis of monomethyl adipate alone.

In this invention, although a batchwise electrolysis is a feature thereof, it is also possible to carry out a continuous electrolysis, that is, the electrolytic condensation at constant concentrations of the raw material monomethyl dicarboxylates in the electrolyte, if one is willing to perform the complicated operations for separating the product dimethyl dicarboxylates from the raw material monomethyl dicarboxylates in the step of purifying the electrolyte. The continuous electrolysis is made possible by the incorporation of the method formerly proposed by the present inventors (Japanese patent application Kokai No. 152672/79, U.S. Pat. No. 4,237,317), which comprises adsorbing the raw material monomethyl dicarboxylate on an anion exchange resin to separate it. Needless to say, this method is also applicable to the separation of the monomethyl ester of a $C_8$–$C_{11}$ carboxylic acid remaining in the electrolyte in the above stated batchwise electrolysis.

In this invention, dimethyl sebacate or dimethyl suberate is always obtained as one of the products. These substances are very important industrially as raw materials of plasticizers, lubricating oils, nylons, adhesives, etc. The amounts of individual products formed can be controlled by varying the molar proportions of the raw materials, monomethyl adipate or monomethyl glutarate and the monomethyl ester of a $C_8$–$C_{11}$ dicarboxylic acid, in the reaction. However, too large amounts of monomethyl adipate or monomethyl glutarate used decrease the amount of the desired dimethyl ester of higher dibasic acid produced, causing a problem in the separation step so that the amount of monomethyl adipate or monomethyl glutarate used should be up to 50 moles, preferably up to 30 moles, per mole of the monomethyl ester of the $C_8$–$C_{11}$ dicarboxylic acid.

BEST MODE FOR CARRYING OUT THE INVENTION

Figure 1:
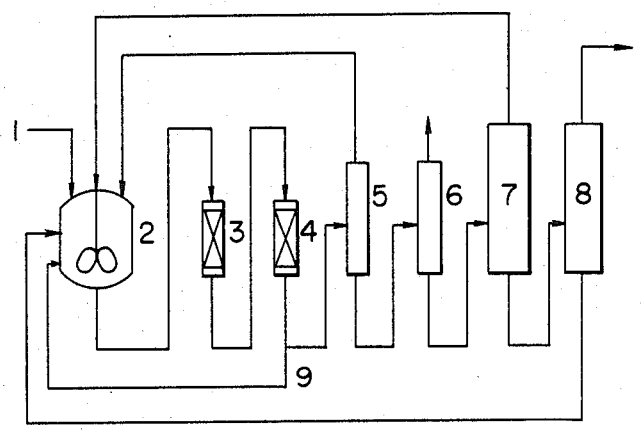
FIGS. 1 and 2 show a flow sheet of an embodiment of the process of the invention for producing dimethyl esters of higher dibasic acids.

Detailed description is given below on the production of dimethyl esters of higher dibasic acids from monomethyl adipate and a monomethyl ester of a $C_8$–$C_{11}$ carboxylic acid.

Monomethyl adipate and the monomethyl ester of a $C_8$–$C_{11}$ dicarboxylic acid used as raw materials can be obtained by esterifying in the ordinary way adipic acid and the $C_8$–$C_{11}$ dicarboxylic acid respectively. In the industrial production, a strongly acidic cation exchange resin is preferred for use as the esterification catalyst. The strongly acidic cation exchange resin used as the catalyst is a polystyrene family resin having sulfonic acid groups, which may have either gel structure or porous structure. The resin used in a continuous esterification should be used as a fixed bed for effective functioning. During long-term continuous use of the strongly acidic cation exchange resin, the amount of metallic ions adsorbed on the resin increases and lowers the esterification catalytic function of the resin gradually. However, its reuse becomes possible, if required, by regenerating methods generally practiced, for example, by the regeneration with aqueous nitric acid. For this purpose, it is desirable to conduct separately the adsorption of metallic ions and the esterification in different columns of ion exchange resin.

The reaction temperature in the fixed bed column packed with the strongly acidic cation exchange resin is preferred for practical operation to be 60°–90° C., in consideration of the heat resistance of the resin, though higher temperatures are more effective with respect to the reaction rate.

When a feed solution is passed through the fixed bed column packed with the strongly acidic cation exchange resin, it is undesirable that the dicarboxylic acid deposits from the feed solution at the operational temperature of the fixed bed. In order to prevent the dicarboxylic acid from depositing from the feed solution, its solvents, for example, methanol and water, and the dimethyl dicarboxylate must be maintained above certain amounts. However, the use of excess solvent is undesirable because it is necessary to remove the solvent in the purification step for separating the monomethyl dicarboxylate from the reaction liquid. Accordingly, in order to prevent adipic acid from depositing from the feed solution without using excess solvent, it will be necessary to compensate for the lack of the solvent in the feed solution by circulating a part of the effluent from the fixed bed. The amount of circulating effluent from the fixed bed, though it cannot be specified because it varies with the amounts of the dicarboxylic acid and of the solvent in the feed solution and with the operational temperature of the fixed bed, may be of a magnitude that does not cause the dicarboxylic acid to deposit from the feed solution. The flow rate of the feed solution through the fixed bed is not particularly limited, but is preferably set in the range wherein the esterification in the fixed bed may proceed nearly to equilibrium.

The solution in which the electrolytic condensation is effected is a methanolic solution containing the raw materials, monomethyl adipate and a monomethyl ester of a $C_8$–$C_{11}$ dicarboxylic acid, and their neutral salts. The solution may further contain the product dimethyl dicarboxylates and other by-products. The electrolytic condensation is operated, basically, batchwise considering the separation and purification of the products in aftertreatment steps. In addition, the electrolytic condensation preferably is continued until the total concentration of monomethyl adipate and monomethyl ester of $C_8$–$C_{11}$ dicarboxylic acid in the electrolyte becomes 1% by weight or less. The electrolytic condensation may be operated in either of the following modes. In one mode, given amounts of both the monomethyl dicarboxylates are charged at the start of the electrolysis, which is then carried out completely batchwise until the total concentration of both monomethyl dicarboxylates is reduced to a given value or less. In the other mode parts of given amounts of both monomethyl dicarboxylates are charged at the start of the electrolysis, the remainders are continuously added during the electrolytic condensation, and subsequently the electrolysis is carried out batchwise until the total concentration of both monomethyl dicarboxylates is reduced to less than a given value. Of the two modes of electrolysis, the latter mode is favorable with respect to the voltage used. In the case of the latter mode of the electrolysis, it is not necessary to keep molar ratio of monomethyl adipate to the monomethyl ester of a $C_8$–$C_{11}$ dicarboxylic acid throughout the electrolytic condensation at 2 or more. However, it is undesirable to lower exceedingly the molar ratio of monomethyl adipate to the monomethyl ester of a $C_8$–$C_{11}$ dicarboxylic acid at the last stage of the electrolysis, since much monomethyl ester of $C_8$–$C_{11}$ dicarboxylic acid remains in this case.

As shown in Examples 6 and 7 and Comparative Examples 6 and 7, when the water concentration in the methanolic solution during the electrolytic condensation is lowered exceedingly, the current efficiency becomes markedly worse; also when the water concentration is increased over 3.5% by weight, the selectivity and the current efficiency become worse. Accordingly, the water concentration needs to be maintained in a range of 0.15–3.5% by weight for the purpose of keeping high the selectivity and the current efficiency.

The mixture of acid esters consisting of monomethyl adipate and a monomethyl ester of a $C_8$–$C_{11}$ dicarboxylic acid in the feed at the electrolytic condensation is used in a concentration of 10–50% by weight. A concentration exceeding 50% by weight results in high voltage. A concentration lower than 10% by weight makes worse the volume efficiency and additionally the current efficiency.

In this invention, hydroxide, carbonate, bicarbonate, methylate, or ethylate of lithium, potassium, or sodium or an amine be used as a neutralizing base for the purpose of enhancing the electric conductivity of the solution in the electrolytic condensation. However, the amine is oxidized on the anode, promoting anode consumption, and the use of the lithium compound makes the current efficiency worse. Accordingly, it is desirable to use hydroxide, carbonate, bicarbonate, or methylate of sodium or potassium. The neutralization degree of the mixture of acid esters consisting of monomethyl adipate and monomethyl ester of a $C_8$–$C_{11}$ dicarboxylic acid at the feeding of the mixture of acid esters (defined as the molar ratio to the mixture of acid esters, of the base required to neutralize it) is preferably 2–50 mole %. The neutralization degree when lower than 2 mole % results in higher voltage and when more than 50 mole % results in low current efficiency. The electrolytic cell to be used may be of a type usually employed for organic electrolytic reactions, provided that the electrolyte can be passed at a high flow rate between its pair of electrodes. For example, the electrolytic cell has parallel opposing cathode and anode plates, between which a polypropylene plate is placed to maintain the space between the electrodes. This polypropylene plate has an opening in the central part for passing the electrolyte. The current conducting areas of the electrodes are depending on the size of this opening, and the electrode spacing on the thickness of this plate. The electrolyte is introduced through a feed inlet provided in the cell, passed between the electrodes to undergo reaction during the passage, and discharged through an effluent outlet to circulate to the electrolyte tank.

As to the electrode materials used for the electrolytic condensation, materials such as platinum, rhodium, ruthenium, iridium, and the like can be used singly or as alloy for the anode; these are used generally in the form of plating. For the plating substrate, there is used titanium, tantalum, or the like. For the cathode, although materials of low hydrogen over-voltage are desirable, there is used, without any particular restriction, platinum, iron, stainless steel, titanium or the like.

The flow rate of the electrolyte in the cell is desired to be 1–4 m/sec. When it is less than 1 m/sec, the current efficiency is low; and when more than 4 m/sec, the pressure loss in the cell is large. The space between the electrodes is desirably 0.5–3 mm. When it is less than 0.5 mm, the pressure loss in the cell is large, and when more than 3 mm, the voltage is high. The current density is desirably 5–40 $A/dm^2$; when it is less than 5 $A/dm^2$, the current efficiency is low. The temperature of the electrolyte is desirably 45°–65° C. The temperature below 45° C. gives low current efficiency and high voltage, and sometimes results in the precipitation of products. The temperature above 65° C. is restricted by the boiling point of the electrolyte.

The separation and purification of the product from the electrolyte after completion of the electrolytic condensation can be accomplished in almost the same way as methods (Japanese Patent Application Kokai Nos. 158285/80 and 44782/81) for the production of dimethyl sebacate by the electrolytic condensation of monomethyl adipate alone, which were proposed formerly by the present inventors. That is, one embodiment of the present method comprises adding water to the electrolyte, removing methanol to separate the mixture into two layers oily and aqueous, purifying products from the oily layer by distillation, and recovering for recycling the alkali salt of monomethyl adipate and/or the monomethyl ester of a $C_8$–$C_{11}$ dicarboxylic acid from the aqueous layer, by adding to the aqueous layer one of the raw materials or both and then evaporating water. According to another embodiment when conditions of the electrolytic condensation are limited so that when the water concentration in the electrolyte is set at 0.6–3.5% by weight and the alkali metal salts of the mixture of acid esters consisting of monomethyl adipate and the monomethyl ester of a $C_8$–$C_{11}$ dicarboxylic acid is set at a concentration of 1% by weight or more in the electrolyte and 3 parts by weight or less based on the water contained in the electrolyte, it is also possible that methanol is simply removed from the electrolyte to separate the remaining liquid into two layers oily and aqueous, the products are purified from the oily layer by distillation, and the aqueous layer is recovered and recycled as it is. In this method, further limitations of the electrolytic condensation conditions are desirable. That is to say, taking into account the purity of the dimethyl ester of higher dibasic acid, the amount of the mixed acid alkali metal salt is preferably 2 parts by weight or less on the water in the electrolyte for the purpose of minimizing the distribution of the mixed acid alkali metal salt into the oily layer in the case of the separattion of the electrolyte into two layers oily and aqueous. In this method, the voltage is somewhat high because the amount of the alkali salts of the mixture of acid esters is limited as far as possible. Therefore, it is very effective to adopt such a mode of electrolysis as stated before, which is favorable in respect to lowering the voltage, that is, the mode of charging parts of given amounts of both monomethyl dicarboxylates at the start of the electrolysis and adding continuously the remainders during the electrolytic condensation, the weight ratio of the previously charged monomethyl esters to the remainders being preferably in the range from 2:8 to 8:2.

Details of the separation and purification process are described below. The latter method differs from the former method only in that the latter involves none of the two operations: the operation of adding water at removal of methanol and the operation of removing water from the aqueous layer after removal of methanol. Accordingly, the former method is described below in detail.

In the step of removing methanol, it is removed after or while adding water to the electrolyte. Water may be added either before the electrolyte is fed to a methanol distillation column or directly to the methanol distillation column. The amount of water added may be in such a degree that the alkali salts of the mixture of acid esters do not deposit in the bottom of the methanol distillation colum when methanol is removed to a lower concentration. However, desirable amounts of water are usually 0.5–5 parts by weight based on the mixed acid alkali metal salt. When the amount is less than 0.5 part by weight, much methanol remains in the residual liquid after removal of methanol; and when more than 5 parts by weight, there is a possibility that the hydrolysis of the ester moiety takes place.

The removal of methanol in the methanol distillation column is effected under ordinary pressure. The methanol concentration in the residual liquid after removal of methanol, though desired to be as low as possible from the viewpoint of inhibiting the distribution of the alkali salts of mixture of acid esters into the oily layer after the subsequent two-layer separation, may be 6% by weight or less, preferably 3% by weight or less, from the industrial point of view. During the distillation of methanol, the bottom temperature of the methanol distillation column reaches 80° C. or higher, and the hydrolysis of the ester moiety will therefore take place if the residual liquid, after removal of methanol, stays in the bottom for a long time. Hence, the residence time is desired to be as short as possible but is allowed to be up to 2 hours.

In the step of separating the product, the dimethyl ester of a higher dibasic acid, from the alkali salts of the mixture of acid esters, the residual liquid after removal of methanol is cooled and left standing to separate into oily and aqueous layers. As stated above, when the amount of methanol remaining in the residual liquid after removal of methanol exceeds 6% by weight, an increased amount of the mixed acid alkali metal salt is distributed into the oily layer and simultaneously the oil-water separation state becomes worse, though this depends upon the amount of the alkali metal salts of the mixture of acid esters and the amount of water. The upper-lower positional relationship of the oily and aqueous layers after standing also varies depending upon the amounts of the alkali metal salts of the mixture of acid esters and of water, and the oily layer underlies if the concentration of remaining methanol is high. Therefore, it is necessary to avoid remaining methanol concentrations around the boundary region where the positional relationship of the oily and aqueous layers is reversed.

In the step of purifying the dimethyl ester of a higher dibasic acid, the purification is accomplished by distillation of the separated oily layer in the ordinary way.

In the step of recovering the alkali metal salts of a mixture of said esters and circulating them to the electrolytic condensation, monomethyl adipate and/or the monomethyl ester of $C_8$–$C_{11}$ a dicarboxylic acid is added previously to the separated aqueous layer and then water is removed by distillation, where the water concentration in the residual liquid can be freely controlled since no precipitation of the alkali metal salts of the mixture of acid esters occurs. This permits very easy control of the water amount throughout the second step. For the monomethyl adipate and monomethyl ester of a $C_8$–$C_{11}$ dicarboxylic acid to be added previously, the raw material of the electrolytic reaction can be utilized, where its amount is desired to be such that alkali metal salts of the mixture of acid esters may not precipitate when water in the residual liquid is removed as far as possible. Since excess amounts of water require a large capacity water evaporator, industrially desirable amounts of this material are usually 1–10 parts by weight versus the amount of the alkali metal salts of the mixture of acid esters salt. When water is removed by evaporation, the residence time of the liquid in the evaporator is desired to be minimized in order to prevent the deterioration due to heating; however, a residence time of up to 10 minutes is allowable industrially. Since monomethyl adipate and the monomethyl ester of a $C_8$–$C_{11}$ dicarboxylic acid are entrained, though not significantly, with the evaporating water, it is desirable to set up a column for recovering these entrained monomethyl adipate and monomethyl ester of a $C_8$–$C_{11}$ dicarboxylic acid.

When the amount of the alkali metal salts of the mixture of acid esters circulated to the electrolytic condensation step is small or generally speaking when their concentration in the feed electrolyte prepared is up to 4.5% by weight, the removal of water from the aqueous layer can also be performed by adding monomethyl adipate and/or the monomethyl ester of a $C_8$–$C_{11}$ dicarboxylic acid after the water is previously removed to a concentration saturated with the alkali metal salts of the mixture of acid esters.

Now, an embodiment of the process for producing dimethyl esters of higher dibasic acids from monomethyl adipate and a monomethyl ester of a $C_8$–$C_{11}$ dicarboxylic acid is illustrated by referring to the flowsheet shown in the drawings. Referring to the first step, 2 is a dissolver, to which are fed the dicarboxylic acid and methanol through a feed inlet 1. There are circulated the methanol and water, dimethyl dicarboxylate, dicarboxylic acid, and monomethyl dicarboxylate, and a part of the reaction liquid withdrawn respectively from the top of a distillation column 5, the top of a distillation column 7, the bottom of a distillation column 8, and through a withdrawal orifice 9. In the dissolver 2 the dicarboxylic acid is dissolved, and sent as the raw material solution to the top of an ion exchange resin column 3. In the ion exchange resin column 3, trace amounts of metallic ions in the raw material are adsorbed and the esterification is partly effected. From the bottom of the ion exchange resin column 3 the liquid freed of metallic ions is withdrawn and sent to the top of an ion exchange resin column 4. In the ion exchange resin column 4 the esterification is chiefly effected. The resin in the ion exchange resin column 3 needs to be regenerated by the general regeneration method, for example, with aqueous nitric acid, when the concentration of metallic ions in the effluent from the bottom becomes a given value or more. From the bottom of the ion exchange resin column 4, the esterification reaction liquid is withdrawn, a part of the liquid is circulated through the withdrawal orifice 9 to the dissolver 2, and the other part is sent to the distillation column 5. In the distillation column 5 methanol and water are distilled off, and the residual liquid is withdrawn from the bottom and sent to a distillation column 6. The methanol and water withdrawn from the top of the distillation column 5 is circulated to the dissolver 2. In the distillation column 6 water and low-boiling point by-products are distilled off, and the residual liquid is withdrawn from the bottom of the column 6 and sent to the distillation column 7. In the distillation column 7 the dimethyl dicarboxylate is distilled off, and the residual liquid is withdrawn from the bottom of the column 7 and sent to a distillation column 8. The dimethyl dicarboxylate distilled off from the top of the distillation column 7 is circulated to the dissolver 2. From the top of the distillation column 8 the monomethyl dicarboxylate is taken, and the residual liquid containing the dicarboxylic acid and monomethyl dicarboxylate is withdrawn from the bottom of the column and circulated to the dissolver 2. The monomethyl dicarboxylate taken from the top of the distillation column 8 is sent to the following second step.

Referring to the second step, 10 is an electrolyte tank, to which are fed monomethyl adipate and the monomethyl ester of a $C_8$–$C_{11}$ dicarboxylic acid obtained in the first step. There are circulated the solutions containing methanol and the alkali metal salts of a mixture of acid esters, which have been withdrawn from the top of a distillation column 12 and the bottom of a recovery column 19. The solution fed into the electrolyte tank 10 is circulated through the space of electrolytic cells 11, wherein the electrolytic condensation is effected. After completion of the electrolytic condensation, the electrolyte is withdrawn from the electrolyte tank 10, supplied at a feed inlet 20 with the water withdrawn from the top of the recovery column 19, and is sent as a water-containing electrolyte to the distillation column 12. In the distillation column 12 methanol is distilled off and circulated to the electrolyte tank, and the residual liquid is withdrawn from the bottom of the column 12 and sent to a decanter 13. In the decanter 13 the feed is separated on standing into two layers. The oily layer thereof is sent to a distillation column 14, and the aqueous layer, after being supplied through a feed inlet 21 with the monomethyl adipate and the monomethyl ester of a $C_8$–$C_{11}$ dicarboxylic acid obtained in the first step, is sent to the bottom of an evaporator 18. In the evaporator 18 water is evaporated, and during the evaporation the evaporated water and the residual liquid are sent from the top of the evaporator 18 to the recovery column 19. From the top of the recovery column 19 water is withdrawn and circulated to the feed inlet 20. From the bottom of the recovery column 19 the alkali metal salts of a mixture of acid esters are withdrawn in the form of a solution and circulated to the electrolyte tank 10. On the other hand, in the distillation column 14 low boiling point impurities are distilled off, and the residual liquid is sent to a distillation column 15. From the distillation column 15, dimethyl sebacate is taken at the top of the column and the residual liquid is sent to a distillation column 16. From the distillation column 16, a dimethyl ester of higher dibasic acid having the secondly high boiling point is taken at the top of the column and the residual liquid is sent to an evaporator 17, from which a dimethyl ester of higher dibasic acid having the highest boiling point is taken at the top. From the bottom of the evaporator 17 high boiling point impurities are withdfawn.

Figure 2:
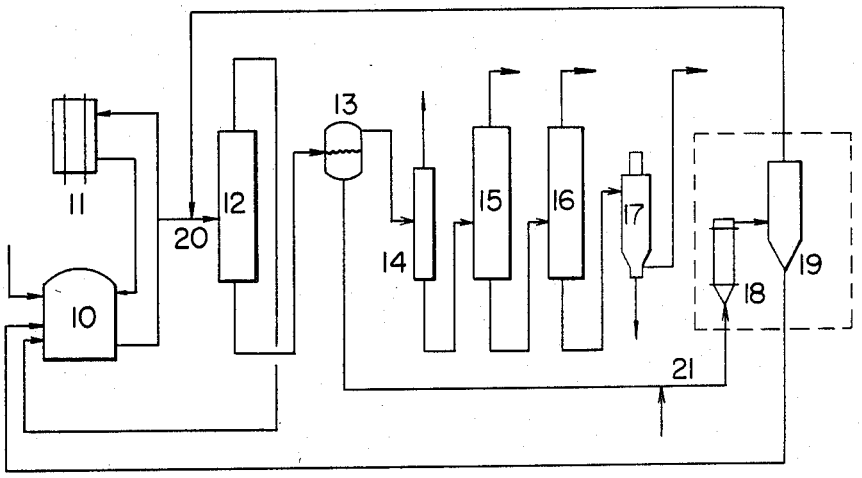

When, in the electrolytic condensation of the second step, the concentration of water in the electrolyte is limited in the range of 0.6–3.5% by weight and the amount of the alkali metal salt of mixed acid of monomethyl adipate and the monomethyl ester of a $C_8$–$C_{11}$ dicarboxylic acid is limited in the range of from 1% by weight based on the electrolyte to 3 parts by weight based on the water contained in the electrolyte, the section bounded by a broken line in FIG. 2, the water supply at the feed inlet 20 or the supply of monomethyl dicarboxylates at the feed inlet 21 is not always necessary. In this case the aqueous layer in the decanter 13 can be directly circulated therefrom to the electrolyte tank 10.

Next, a detailed description is given of the production of dimethyl esters of higher dibasic acids from monomethyl glutarate and the monomethyl ester of a $C_8$–$C_{11}$ dicarboxylic acid.

The monomethyl ester of $C_8$–$C_{11}$ dicarboxylic acid to be used can be obtained in the previously stated manner.

The monomethyl glutarate, on the other hand, must be prepared by the reaction of glutaric anhydride and methanol as stated above. The glutaric anhydride to be used in this reaction is prepared by heating glutaric acid to dehydrate it at 150°–270° C., preferably 200°–250° C., under reduced or ordinary pressure without solvent or in an inert solvent having a boiling point of at the lowest 150° C. In this case, it is desirable that the dehydration without solvent be completed under a slightly reduced pressure and the dehydration in a solvent be completed by using a slight excess of the solvent to remove water along with the solvent, and that the anhydride obtained be purified thereafter by distillation. If the dehydration is incomplete, this is undesirable, since the dehydration further proceeds during the distillation, water is therefore distilled off along with glutaric anhydride, and in consequence some glutaric acid forms and contaminates the purified glutaric anhydride.

Next, in the reaction of glutaric anhydride and methanol, it is desirable to use some excess of methanol, preferably an amount of methanol between 1 and 3 moles per mole of glutaric anhydride. The use of more excess of methanol is undesirable since trace water contained in methanol forms some glutaric acid. The reaction is successful by conducting at a temperature between 40° C. and the reflux point of methanol for 2–10 hours, where any catalyst may not be used. After completion of the reaction, the monomethyl glutarate may be purified by distillation, but desirably the resulting reaction liquid is used as it is in the form of methanolic solution for the electrolytic condensation, because monomethyl glutarate is converted, though very slightly, into glutaric acid and dimethyl glutarate during the distillation and a trace amount of glutaric anhydride contaminates the distilled monomethyl glurarate.

The glutaric anhydride can also be prepared by using as a raw material a mixture of succinic acid, glutaric acid, and adipic acid, which mixture is incidentally produced in industrial production of adipic acid, in the same manner as in the above case where glutaric acid alone is used.

The electrolytic reaction using monomethyl glutarate obtained in the above stated manner and the monomethyl ester of a $C_8$–$C_{11}$ dicarboxylic acid, and the separation and purification of the reaction products were carried out in the same manner as in the above case where monomethyl adipate was used.

As described above in detail, the process of this invention has advantages over the processes which have been put into operation or proposed until now. The advantages are: in the first place, raw materials are very easy to obtain and additionally inexpensive; moreover, none of special chemicals and chemicals causing safety problems are used. In the second place, intended products can be obtained in exceedingly high yields and with high current efficiencies. Thus reaction products can be purified very easily to give intended final products, and the final products have high purity.

EXAMPLES 1–3, COMPARATIVE EXAMPLES 1–4, AND REFERENCE EXAMPLE 1

Monomethyl adipate was obtained in the following way: a solution was prepared as a feed liquid to an ion exchange resin column by mixing 1 part by weight (hereinafter referred to as wt. part) of a liquid consisting of 33.2 wt% of adipic acid, 32.3 wt% of dimethyl adipate, 3.3 wt% of monomethyl adipate, 12.4 wt% of methanol, and 18.8 wt% of water with 4.27 wt parts of a liquid consisting of 20.8 wt% of adipic acid, 22.6 wt% of dimethyl adipate, 37.0 wt% of monomethyl adipate, 3.6 wt% of methanol, and 16.1 wt% of water.

Then, 100 ml (on the basis of water) of a strongly acidic cation exchange resin, Amberite 200C (tradename, mfd. by Rohm & Haas Co.), regenerated into H-form was replaced with water and packed in a column (inner diameter 15 mm, height 1000 mm, jacketed), and hot water at 80° C. was passed through the jacket.

Then, 2 Kg of the feed liquid to ion exchange resin column, after being heated to 80° C., was passed downward through the ion exchange resin column at a S.V. of 4. The effluent, from which 400 g of the initial effluent was removed, was taken as the sample of the reaction product solution. The results of gas chromatographic analysis of the reaction product solution indicated that it contained 37.1 wt% of monomethyl adipate and 22.4 wt% of dimethyl adipate. The purification and separation of monomethyl adipate from this reaction product solution was carried out by distillation.

Monomethyl azelate was obtained in the following way: a solution was prepared as a feed liquid to the ion exchange resin column by mixing 1 wt part of a liquid consisting of 33.0 wt% of azelaic acid, 29.4 wt% of dimethyl azelate, 0.9 wt% of monomethyl azelate, 10.3 wt% of other dicarboxylic acids, 10.8 wt% of methanol, and 16.5 wt% of water with 4.5 wt parts of a liquid consisting of 18.3 wt% of azelaic acid, 19.2 wt% of dimethyl azelate, 31.9 wt% of monomethyl azelate, 14.4 wt% of other dicarboxylic acids, 3.0 wt% of methanol, and 13.2 wt% of water. This feed liquid was passed through the ion exchange resin column in completely the same manner as in the case of the above preparation of monomethyl adipate. In the obtained reaction product solution, the content of monomethyl azelate was 32.0 wt% and the content of dimethyl azelate was 19.1 wt%. The purification and separation of monomethyl azelate from this reaction product solution was carried out by distillation.

Electrolytic condensation reaction was conducted using the monomethyl adipate and monomethyl azelate prepared as stated above. That is, the amounts shown in Table 1 of the monomethyl adipate and/or monomethyl azelate were placed in an electrolyte tan, then potassium hydroxide was added so as to give a neutralization degree of 8% of the dicarboxylic acids, then methanol was added, and finally water was added so as to give a water concentration of 3.0 wt% in the feed solution. This prepared solution was circulated to an electrolytic cell.

In the cell, both electrodes had a current conducting area of 1.0 cm×100 cm, the cathode was a 2-mm titanium plate, and the anode was a 2-mm titanium plate plated with platinum in 4μ thick. The space between the electrodes was fixed to 1 mm by inserting therebetween a 1-mm thick polyethylene plate having such an opening as to keep a current conducting area of 1.0 cm×100 cm between both electrodes. The cell used was provided with an inlet and an outlet for liquid. The electrolysis was conducted by passing the electrolyte between both electrodes at a flow rate of 2 m/sec while maintaining the current density at 20 A/dm$^2$ and the liquid temperature at 50°–52° C. The electrolysis was continued while sampling the electrolyte and measuring the amount of remaining monomethyl adipate by gas chromatographic analysis. The moment this amount becomes below 0.1 wt% was taken as the criterion for the end point of the electrolysis. After completion of the electrolysis, each component in the electrolyte was determined by gas chromatographic analysis. Results thereof are shown in Table 1.

The selectivity and current efficiency were calculated on the assumption that monomethyl adipate and monomethyl azelate have been neutralized with potassium hydroxide in the same respective molar proportions as of both the carboxylic acids charged.

The neutralization degree of carboxylic acid in the prepared electrolyte is represented by the following equation: Neutralization degree=(moles of mixed acid potassium salt)×100/(moles of mixed acid+moles of mixed acid potassium salt).

The current efficiency was determined considering that one mole of each product is formed with a quantity of electricity of 2 faradays. Equations for calculating the selectivity and current efficiency are as follows:

Selectivity to dimethyl adipate based on monomethyl adipate=(2×moles of produced dimethyl sebacate)×100/(moles of monomethyl adipate consumed). Selectivity to dimethyl brassilate based on monomethyl adipate or on monomethyl azelate=(moles of produced dimethyl brassilate)×100/(moles of consumed monomethyl adipate or monomethyl azelate) Selectivity to dimethyl thapsate based on monomethyl azelate=(2-×moles of produced dimethyl thapsate)×100/(moles of consumed monomethyl azelate). Current efficiency=(2×moles of each component produced)×100-/quantity of electric charge passed (faraday unit)

In the following Examples and Comparative Examples, the above equations were applied to calculations.

COMPARATIVE EXAMPLE 5

Electrolytic condensation was conducted in completely the same manner as in Comparative Example 1 but the electrolytic condensation was further continued after the concentration of monomethyl adipate in the electrolyte had reduced to 0.1 wt%. At this moment the voltage began rising; the electrolysis was stopped at the time that the voltage reached 60 V. Results thereof are shown in Table 1.

TABLE 1

| | Molar ratio of monomethyl adipate to monomethyl azelate in charge | Amount of charge before reaction (g) | | | Amount of liq. at the end of reaction (g) | Period of electrolysis (hrs) | Voltage (average voltage) (V) |
|---|---|---|---|---|---|---|---|
| | | Methanol | Monomethyl adipate | Monomethyl azelate | | | |
| Reference Example 1 | 1/0 | 561 | 391 | 0 | 871 | 3.92 | 11.6–9.1 (10.4) |
| Example 1 | 10/1 | 550 | 356 | 45 | 880 | 3.75 | 12.5–8.9 (10.7) |
| Example 2 | 5/1 | 544 | 326 | 82 | 882 | 3.75 | 12.5–9.3 (10.9) |
| Example 3 | 2/1 | 528 | 268 | 171 | 883 | 3.90 | 12.9–9.7 (11.3) |
| Comparative Example 1 | 1/1 | 505 | 196 | 247 | 870 | 3.90 | 14.7–11.3 (13.0) |
| Comparative Example 2 | 1/2 | 486 | 130 | 329 | 875 | 3.90 | 16.4–12.0 (14.2) |
| Comparative Example 3 | 1/10 | 458 | 36 | 449 | 878 | 3.90 | 18.4–13.4 (15.9) |
| Comparative Example 4 | 0/1 | 448 | 0 | 482 | 876 | 4.00 | 19.5–14.5 (17.0) |
| Comparative Example 5 | 1/1 | 505 | 196 | 247 | 866 | 4.17 | 14.7–11.3 –60 |

| | Component concentration at the end of reaction (wt %) | | | | Selectivity (%) Based on monomethyl adipate | | |
|---|---|---|---|---|---|---|---|
| | Dimethyl sebacate | Dimethyl brassylate | Dimethyl thapsate | Remaining monomethyl azelate | Dimethyl sebacate | Dimethyl brassylate | Total |
| Reference Example 1 | 24.4 | 0 | 0 | 0 | 82 | — | 82 |
| Example 1 | 20.0 | 4.3 | 0.2 | 0.4 | 75 | 7 | 82 |
| Example 2 | 17.2 | 6.7 | 0.9 | 0.5 | 70 | 12 | 82 |
| Example 3 | 11.3 | 11.9 | 3.4 | 0.6 | 56 | 25 | 81 |
| Comparative Example 1 | 6.7 | 12.3 | 6.8 | 2.5 | 45 | 35 | 80 |
| Comparative Example 2 | 3.2 | 11.1 | 12.1 | 3.2 | 32 | 48 | 80 |
| Comparative Example 3 | 2.7 | 4.3 | 22.9 | 5.6 | 10 | 6 | 78 |
| Comparative Example 4 | 0 | 0 | 25.5 | 7.2 | — | — | — |
| Comparative Example 5 | 6.7 | 12.4 | 7.0 | 2.0 | 45 | 35 | 80 |

| | Selectivity (%) Based on monomethyl azelate | | | Current efficiency (%) | | | |
|---|---|---|---|---|---|---|---|
| | Dimethyl brassylate | Dimethyl thapsate | Total | Dimethyl sebacate | Dimethyl brassylate | Dimethyl thapsate | Total |
| Reference Example 1 | — | — | — | 63 | — | — | 63 |
| Example 1 | 73 | 6 | 79 | 55 | 10 | 0.5 | 65.5 |
| Example 2 | 62 | 14 | 76 | 47 | 16 | 2 | 65 |
| Example 3 | 51 | 26 | 77 | 30 | 27 | 6 | 63 |
| Comparative Example 1 | 39 | 38 | 77 | 17 | 27 | 13 | 57 |
| Comparative Example 2 | 26 | 50 | 76 | 8 | 24 | 23 | 55 |
| Comparative Example 3 | 8 | 71 | 79 | 1 | 9 | 44 | 54 |
| Comparative Example 4 | — | 75 | 75 | — | — | 48 | 48 |
| Comparative Example 5 | 38 | 37 | 75 | 16 | 25 | 12 | 53 |

EXAMPLE 4

Using the same electrolytic apparatus as used in Example 1, 235 g of monomethyl adipate, 59 g of monomethyl azelate, and 579 g of methanol were placed in the electrolyte tank, then potassium hydroxide was added so as to give a neutralization degree of 10% of the dicarboxylic acids, and finally water was added so as to give a water concentration of 1.8 wt% in the liquid. The molar ratio of monomethyl adipate to monomethyl azelate in the charge was 5:1. Then, the electrolytic condensation was conducted under the same set conditions as in Example 1, except that the current density was changed to 11 A/dm$^2$, while a mixture of 92 g of monomethyl adipate and 22 g of monomethyl azelate (molar ratio monomethyl adipate/monomethyl azelate=5:1) was continuously supplied to the electrolyte tank for 5.0 hours. The electrolytic condensation was continued for 2 additional hours. The voltage was 6.8–6.6 V. The amount of the liquid after electrolysis was 900 g. Results of gas chromatographic analysis of the concentration of each component in the liquid showed that the liquid contained 17.0 wt% of dimethyl sebacate, 6.5% dimethyl brassylate, 0.8% dimethyl thapsate, and 0.6 wt% of remaining monomethyl azelate. The water concentration was 1.9 wt%. The selectivity and current efficiency for each electrolytic condensation product are shown in Table 2.

Subsequently, electrolytic condensation was conducted repeatedly to obtain 10 kg of an electrolyte. This electrolyte, after addition of 0.73 kg of water, was fed into a middle stage of a distillation column, and while heating the bottoms at 98° C. under ordinary pressure, methanol and an oil-water mixture were continuously withdrawn from the top and bottom of the column, respectively. The average residence time at the bottom of the distillation column was 1 hour and the average methanol concentration in the liquid withdrawn from the bottom of the column was 1.1 wt%. The liquid withdrawn from the column was separated into two layers in a decanter after cooling. The oily layer weighted 2.3 kg, wherein 0.01 wt% of the potassium salt of the mixture of acid esters consisting of monomethyl adipate and monomethyl azelate was distributed on the assumption that the 5:1 molar ratio of the former salt to the latter would be kept. From the oily layer, dimethyl sebacate, dimethyl brassylate, and dimethyl thapsate were each isolated by further distillation. The aqueous layer weighed 1.40 kg. After addition of 1.33 kg of monomethyl adipate to the aqueous layer, water was evaporated therefrom in an evaporator at 125° C. under ordinary pressure. The residence time of the liquid in the evaporator was 3 minutes, and after evaporation of water, the water concentration in the monomethyl adipate solution containing potassium salts of monomethyl adipate and of monomethyl azelate was 7.2 wt%. This solution was recovered and reused for electrolytic condensation.

EXAMPLE 5

Using the same electrolytic apparatus as used in Example 1, 289 g of monomethyl adipate, 44 g of monomethyl azelate, and 664 g of methanol were placed in the electrolyte tank, then potassium hydroxide was added so as to give a neutralization degree of 10% of the dicarboxylic acids, and finally water was added so as to give a water concentration of 3.3 wt% in the liquid. Then, the electrolytic condensation was conducted under the same set conditions as in Example 1, except that the current density was changed to 11 A/dm$^2$, while supplying continuously 107 g of monomethyl adipate to the electrolyte tank for 5 hours. After completion of the supplement of monomethyl adipate, the electrolytic condensation was further continued for 2.78 hours until the concentrations of monomethyl adipate and monomethyl azelate were both reduced to below 0.1 wt%. The voltage was 6.7–6.4 V. The amount of the liquid after electrolysis was 1,026 g. Results of gas chromatographic analysis of each component in the liquid showed that the liquid contained 19.1 wt% of dimethyl sebacate, 3.1 wt% of dimethyl brassylate, and 0.3 wt% of dimethyl thapsate. The water concentration in the liquid was 3.3 wt%. The results are shown in Table 2.

Subsequently, the electrolytic condensation was conducted repeatedly to obtain 10 kg of an electrolyte. This electrolyte was continuously fed into a middle stage of a distillation column, and while heating the bottom of the column at 98° C. under ordinary pressure, methanol and an oil-water mixture were continuously withdrawn from the top and bottom of the column, respectively. The average residence time at the bottom of the distillation column was 1 hour and the average methanol concentration in the liquid withdrawn from the column was 1.50 wt%. The liquid withdrawn from the column was separated into two layers in a decanter after cooling. The oily layer weighed 2.99 kg, wherein 0.03 wt% of the potassium salt of the mixed acid of monomethyl adipate and monomethyl azelate was distributed on the assumption that these salts would be present in the same ratio as in the feed at the start of electrolysis. From the oily layer, dimethyl sebacate, dimethyl brassylate, and dimethyl thapsate were each isolated by further distillation. The aqueous layer weighed 0.72 kg, wherein the total concentration of potassium salts of monomethyl adipate and monomethyl azelate was 50 wt%. These salts were recovered as such and reused for electrolytic condensation.

EXAMPLE 6

Using the same electrolytic apparatus as used in Example 1, 358 g of monomethyl adipate, 44 g of monomethyl azelate, and 548 g of methanol were placed in the electrolyte tank, then sodium hydroxide was added so as to give a neutralization degree of 10% of the carboxylic acids, and finally water was added so as to give a water concentration of 2.5 wt% in the liquid. The molar ratio of monomethyl adipate to monomethyl azelate in the charge was 10:1.

Then, electrolytic condensation was conducted under the same set conditions as in Example 1, except that the current density was changed to 10 A/dm$^2$. The electrolysis was continued for 7.70 hours until the concentrations of monomethyl adipate and monomethyl azelate were both reduced to below 0.1 wt%. The voltage changed from 7.7 to 5.8 V. The amount of the liquid after the electrolytic condensation was 883 g. Concentrations of components in the liquid were 19.4 wt% of dimethyl sebacate, 4.3 wt% of dimethyl brassylate, and 0.2 wt% of dimethyl thapsate. The selectivity and current efficiency for each electrolytic condensation product are shown in Table 2.

EXAMPLE 7

Electrolysis was conducted for 7.12 hours in the same manner as in Example 6 except that the amount of monomethyl azelate was changed to 15 g. The voltage changed from 7.5 to 5.7 V. The amount of the liquid after completion of the electrolysis was 856 g. Concentrations of components in the liquid were 21.1 wt% of dimethyl sebacate, 1.6 wt% of dimethyl brassylate, and 0.05 wt% or less of dimethyl thapsate. The selectivity and current efficiency for each electrolytic condensation product are shown in Table 2.

TABLE 2

| | Selectivity (%) | | | | | | Current efficiency (%) | | | |
|---|---|---|---|---|---|---|---|---|---|---|
| | Based on monomethyl adipate | | | Based on monomethyl azelate | | | | | | |
| | Dimethyl sebacate | Dimethyl brassylate | Total | Dimethyl brassylate | Dimethyl thapsate | Total | Dimethyl sebacate | Dimethyl brassylate | Dimethyl thapsate | Total |
| Example 4 | 70 | 11 | 81 | 63 | 13 | 76 | 46 | 15 | 2 | 63 |
| Example 5 | 73 | 6 | 79 | 69 | 7 | 76 | 52 | 9 | 0.4 | 61.4 |
| Example 6 | 74 | 7 | 81 | 71 | 6 | 77 | 52 | 10 | 1 | 63 |
| Example 7 | 78 | 3 | 81 | 77 | — | 77 | 59 | 4 | — | 63 |
| Comparative Example 6 | 66 | 6 | 72 | 63 | 5 | 69 | 39 | 7 | 1 | 47 |

COMPARATIVE EXAMPLE 6

Electrolytic condensation was conducted in completely the same manner as in Example 6 except that the water concentration in the charge was changed to 4.5 wt%. The period of electrolysis was 9.04 hours, the voltage changed from 7.5 to 5.6 V, and the amount of the liquid after electrolytic condensation was 878 g. Concentrations of components in the liquid were 17.4 wt% of dimethyl sebacate, 3.8 wt% of dimethyl brassylate, and 0.2 wt% of dimethyl thapsate. The selectivity and current efficiency for each electrolytic condensation product are shown in Table 2.

COMPARATIVE EXAMPLE 7

Electrolytic condensation was conducted in completely the same manner as in Example 6 except that the alkali for neutralizing the mixed acid was changed from 9.9 g of sodium hydroxide in Example 6 to 13.4 g of sodium methylate and the water concentration in the liquid charge was changed to 0.10 wt%. Although the electrolytic condensation was continued for one hour, almost no electrolytic condensation product formed.

EXAMPLES 8-10 AND COMPARATIVE EXAMPLES 8 AND 9

Using a strongly acidic cation exchange resin as an esterifying catalyst, monomethyl adipate and monomethyl undecanedioate were prepared in the same way as in Example 1.

Subsequently, electrolytic condensation was conducted using the monomethyl adipate and monomethyl undecanedioate. Except for the use of monomethyl undecanedioate in place of monomethyl azelate, the manner of the electrolytic condensation was completely the same as in Example 1. The results are shown in Table 3.

COMPARATIVE EXAMPLE 10

In completely the same manner as in Comparative example 4, electrolytic condensation was conducted, and after the concentration of monomethyl adipate in the electrolyte reduced to below 0.1 wt%, the electrolytic condensation was continued. At this time, the voltage began rising. The electrolysis was stopped at the moment the voltage reached 60 V. The results are shown in Table 3.

TABLE 3

| | Mole ratio of monomethyl adipate to monomethyl undecanedioate in charge | Amount of charge before reaction (g) | | | Amount of liq. at the end of reaction (g) | Period of electrolysis (hrs) | Voltage (average voltage) (V) |
|---|---|---|---|---|---|---|---|
| | | Methanol | Monomethyl adipate | Monomethyl undecanedioate | | | |
| Example 8 | 10/1 | 552 | 356 | 46 | 883 | 3.92 | 12.4-9.1 (10.8) |
| Example 9 | 5/1 | 550 | 326 | 88 | 889 | 3.92 | 12.6-9.3 (11.0) |
| Example 10 | 2/1 | 532 | 286 | 193 | 890 | 4.00 | 13.1-9.8 (11.5) |
| Comparative Example 8 | 1/1 | 512 | 196 | 281 | 884 | 4.20 | 15.7-11.9 (13.8) |
| Comparative Example 9 | 1/2 | 493 | 130 | 371 | 887 | 4.45 | 13.2-13.2 (15.7) |
| Comparative Example 10 | 1/1 | 512 | 196 | 281 | 879 | 4.58 | 15.7-11.9 -60 |

| | Component concentration at the end of reaction (wt %) | | | | Selectivity (%) Based on monomethyl adipate | | |
|---|---|---|---|---|---|---|---|
| | Dimethyl sebacate | Dimethyl pentadecanedioate | Dimethyl eicosanedioate | Remaining monomethyl undecanedioate | Dimethyl sebacate | Dimethyl pentadecanedioate | Total |
| Example 8 | 19.7 | 4.5 | 0.2 | 0 | 74 | 7 | 81 |
| Example 9 | 16.9 | 7.4 | 1.0 | 0 | 69 | 12 | 81 |
| Example 10 | 11.2 | 12.5 | 3.9 | 0.7 | 56 | 24 | 80 |
| Comparative Example 8 | 16.6 | 13.4 | 7.9 | 2.9 | 45 | 35 | 80 |
| Comparative | 13.0 | 11.9 | 13.9 | 3.5 | 31 | 47 | 78 |

TABLE 3-continued

| | | | | | | | |
|---|---|---|---|---|---|---|---|
| Example 9 | | | | | | | |
| Comparative Example 10 | 16.6 | 13.5 | 8.0 | 2.5 | 45 | 35 | 80 |

| | Selectivity (%) Based on monomethyl undecanedioate | | | Current efficiency (%) | | | |
|---|---|---|---|---|---|---|---|
| | Dimethyl pentadecanedioate | Dimethyl eicosanedioate | Total | Dimethyl sebacate | Dimethyl pentadecanedioate | Dimethyl eicosanedioate | Total |
| Example 8 | 72 | 5 | 77 | 53 | 9 | 1 | 63 |
| Example 9 | 62 | 14 | 76 | 45 | 15 | 2 | 62 |
| Example 10 | 50 | 26 | 76 | 29 | 25 | 6 | 60 |
| Comparative Example 8 | 39 | 37 | 76 | 17 | 25 | 12 | 54 |
| Comparative Example 9 | 26 | 49 | 75 | 7 | 21 | 20 | 48 |
| Comparative Example 10 | 38 | 37 | 75 | 15 | 23 | 11 | 49 |

EXAMPLE 11

Monomethyl adipate and monomethyl suberate were obtained by esterififying adipic acid and suberic acid, respectively, in the presence of a strongly acidic cation exchange resin as an esterification catalyst.

Then, electrolytic condensation was conducted by using the monomethyl adipate and monomethyl suberate. Except for the use of monomethyl suberate, the manner of the electrolytic condensation was completely the same as in Example 1. The results were as follows:

| Molar ratio of monomethyl adipate to monomethyl suberate in charge | Amount of charge before reaction (g) | | | Amount of liq. at the end of reaction (g) | Period of electrolysis (hrs) | Voltage (average voltage) (V) |
|---|---|---|---|---|---|---|
| | Methanol | Monomethyl adipate | Monomethyl suberate | | | |
| 10/1 | 550 | 356 | 42 | 877 | 3.84 | 12.1–8.6 |

| Component concentration at the end of reaction (wt %) | | | | Selectivity (%) Based on monomethyl adipate | | |
|---|---|---|---|---|---|---|
| Dimethyl sebacate | Dimethyl dodecanedioate | Dimethyl tetradecanedioate | Remaining monomethyl suberate | Dimethyl sebacate | Dimethyl dodecanedioate | Total |
| 19.9 | 4.3 | 0.2 | 0.1 | 74 | 7 | 81 |

| Selectivity (%) Based on monomethyl suberate | | | Current efficiency (%) | | | |
|---|---|---|---|---|---|---|
| Dimethyl dodecanedioate | Dimethyl tetradecanedioate | Total | Dimethyl sebacate | Dimethyl dodecanedioate | Dimethyl tetradecanedioate | Total |
| 73 | 5 | 78 | 53 | 10 | 0.4 | 63.4 |

EXAMPLE 12

Monomethyl adipate and monomethyl sebacate were obtained by esterification of adipic acid and sebacic acid, respectively in the presence of a strongly acidic cation exchange resin as an esterification catalyst.

Using the same electrolytic apparatus as used in Example 1, the monomethyl adipate, monomethyl sebacate, and methanol were placed in the electrolyte tank, then sodium hydroxide was added so as to give a neutralization degree of 10% of the dicarboxylic acids, and finally water is added so as to give a water concentration of 2.0 wt% in the liquid. Then, electrolysis was conducted under the same set conditions as in Example 1 except that the current density was changed to 10 A/dm$^2$. The results were as follows.

| Molar ratio of monomethyl adipate to monomethyl sebacate in charge | Amount of charge before reaction (g) | | | Amount of liq. at the end of reaction (g) | Period of electrolysis (hrs) | Voltage (average voltage) (V) |
|---|---|---|---|---|---|---|
| | Methanol | Monomethyl adipate | Monomethyl sebacate | | | |
| 5/1 | 550 | 330 | 89 | 898 | 7.54 | 12.5–9.1 |

| Component concentration at the end of reaction (wt %) | Selectivity (%) Based |
|---|---|

-continued

| Dimethyl sebacate | Dimethyl tetradecanedioate | Dimethyl octadecanedioate | Remaining monomethyl sebacate | on monomethyl adipate: Dimethyl sebacate | Dimethyl tetradecanedioate | Total |
|---|---|---|---|---|---|---|
| 16.4 | 7.1 | 0.9 | 0.4 | 69 | 12 | 81 |

| Selectivity (%) Based on monomethyl sebacate: Dimethyl tetradecanedioate | Dimethyl octadecanedioate | Total | Current efficiency (%): Dimethyl sebacate | Dimethyl tetradecanedioate | Dimethyl octadecanedioate | Total |
|---|---|---|---|---|---|---|
| 63 | 13 | 76 | 45 | 16 | 2 | 63 |

EXAMPLE 13

An acid mixture of 13.3 wt% of adipic acid 63.7 wt% of glutaric acid, and 23.0 wt% of succinic acid was heated at 230°-250° C. under reduced pressure to remove water. Then, the temperature was once lowered, succinic anhydride was removed at 140°-145° C. under a reduced pressure of 15 mmHg, and glutaric anhydride was obtained at 160°-165° C. 228 g of the glutaric anhydride was reacted with 72 g of methanol at 55° C. for 5 hours.

The above monomethyl glutarate, which is the reaction product of the anhydride with methanol, 216 g of monomethyl sebacate, and 604 g of methanol were placed in an electrolyte tank, they potassium hydroxide was added so as to give a neutralization degree of 8% of the acid mixture, and finally the water content in the solution was adjusted to 3.0 wt%. The thus prepared liquid was circulated to an electrolytic cell.

The electrolysis was conducted in the same manner as in Example 1. The period of electrolysis was 4.74 hours, during which the voltage changed from 13.5 to 10.2 V. The amount of the liquid after completion of the electrolysis was 1,021 g, wherein the concentrations of components were 10.0 wt% of dimethyl suberate, 11.8 wt% of dimethyl brassylate, and 3.9 wt% of dimethyl octadecanedioate. The concentration of remaining unreacted monomethyl sebacate was 0.7 wt%. The selectivity and current efficiency for each electrolytic condensation product are shown in Table 4.

EXAMPLE 14

Dehydration reaction was conducted by adding 5 wt parts of decalin to 1 wt part of glutaric acid and heating the mixture under reflux while formed water was taken off together with a small amount of decalin out of the system. After the dehydration reaction was thoroughly carried out, decalin was removed by distillation, and subsequently glutaric anhydride was obtained by distillation. Monomethyl glutarate was prepared by reacting 167 g of the glutaric anhydride obtained and 59 g of methanol at 55° C. for 4 hours. This monomethyl glutarate, 63 g of monomethyl sebacate, and 568 g of methanol were placed in an electrolyte tank, and the water concentration in the liquid was adjusted to 2.0 wt% by adding water. Then, potassium hydroxide was added so as to make the neutralization degree 10%. Subsequently, electrolytic condensation was conducted under the same set conditions as in Example 1, except that the current density was changed to 11 A/dm$^2$, while a mixture of 24 g of monomethyl sebacate and the monomethyl glutarate prepared from 66 g of glutaric anhydride and 23 g of methanol in the same way as the above (monomethyl glutarate: monomethyl sebacate molar ratio in the mixture: 5:1) was continuously supplied to the electrolyte tank for 5 hours. The electrolytic condensation was further continued for 2.4 hours. The voltage was 7.1-6.9 V. The amount of the liquid after completion of the electrolysis was 903 g, in which concentrations of components were 13.6 wt% of dimethyl suberate, 6.3 wt% of dimethyl brassylate, and 0.7 wt% of dimethyl octadecanedioate. The concentration of remaining unreacted monomethyl sebacate was 0.6 wt%. The selectivity and current efficiency for each electrolytic condensation product are shown in Table 4.

COMPARATIVE EXAMPLE 11

In a 4-l four-necked flask were placed 119 g of glutaric acid, 566 g of dimethyl glutarate, 458 g of methanol, and 409 g of water. Then, 300 ml of a strongly acidic cation exchange resin, Amberite 200 C (tradename, mfd. by Rohm & Haas Co.), regenerated into H-form was added, after methanol replacement and thorough removal of water. The mixture was heated under reflux for 6 hours while thoroughly stirring. After removing the catalyst, methanol, and water, 259 g of dimethyl glutarate and 250 g of monomethyl glutarate were obtained by distillation. The monomethyl glutarate was obtained at 133°-135° C. under reduced pressures of 3-4 mmHg. Then, the monomethyl glutarate obtained was heated at 220°-230° C. for 1 hour under reduced pressures of 50-100 mm Hg, and successively was distilled again at 160°-165° C. under a reduced pressure of 15 mmHg.

In an electrolyte tank were placed 292 g of the monomethyl glutarate, 216 g of monomethyl sebacate, and 615 g of methanol. Potassium hydroxide was added so as to give a neutralization degree of 8% of the acid mixture. The water content in the solution was adjusted to 2.5 wt%.

The electrolytic condensation was conducted for 5.01 hours in completely the same manner as in Example 1. The voltage changed from 15.0 to 12.2 V. The amount of the liquid after completion of the electrolysis was 1,022 g, wherein concentrations of components were 7.8 wt% of dimethyl suberate, 9.8 wt% of dimethyl brassylate, and 3.2 wt% of dimethyl octadecanedioate. The concentration of remaining unreacted monomethyl sebacate was 1.7 wt%. The selectivity and current efficiency for each electrolytic condensation product are shown in Table 4.

TABLE 4

| | Selectivity (%) | | | | | | Current efficiency (%) | | | |
|---|---|---|---|---|---|---|---|---|---|---|
| | Based on monomethyl glutamate | | | Based on methyl sebacate | | | | | | |
| | Dimethyl suberate | Dimethyl brassylate | Total | Dimethyl brassylate | Dimethyl octadecane-dioate | Total | Dimethyl suberate | Dimethyl brassylate | Dimethyl octadecane-dioate | Total |
| Example 13 | 55 | 24 | 79 | 50 | 26 | 76 | 29 | 25 | 6 | 60 |
| Example 14 | 64 | 11 | 75 | 60 | 11 | 71 | 40 | 14 | 1 | 55 |
| Comparative Example 11 | 43 | 20 | 63 | 44 | 23 | 67 | 21 | 20 | 5 | 46 |

We claim:

1. In a process for producing long-chain dimethyl esters of higher dibasic acids, the improvement comprising condensing electrolytically and batchwise a mixture of acid esters consisting of monomethyl adipate or monomethyl glutarate essentially free of glutaric anhydride and glutaric acid and a monomethyl ester of a $C_8$–$C_{11}$ dicarboxylic acid in a methanolic solution containing alkali metal salts of said acid esters, in a molar ratio of at least 2 of the monomethyl adipate or the monomethyl glutarate essentially free of glutaric anhydride and glutaric acid to the monomethyl ester of a $C_8$–$C_{11}$ dicarboxylic acid, while keeping the water concentration in said methanolic solution at 0.15–3.5% by weight, wherein said electrolytic condensation is conducted until the sum of concentrations of the monomethyl glutarate essentially free of glutaric anhydride and glutaric acid and the monomethyl ester of a $C_8$–$C_{11}$ dicarboxylic acid is reduced to 1% by weight or less.

2. A process according to claim 1, wherein the monomethyl adipate and the monomethyl ester of a $C_8$–$C_{11}$ dicarboxylic acid are prepared by half-esterification of adipic acid and the $C_8$–$C_{11}$ dicarboxylic acid, respectively, with methanol in the presence of a strongly acidic cation exchange resin as a catalyst.

3. A process according to claim 1, wherein the monomethyl glutarate essentially free of glutaric anhydride and glutaric acid is prepared by dehydrating glutaric acid with heating to form glutaric anhydride, and reacting this glutaric anhydride with methanol.

4. A process according to claim 1, wherein the amount of the monomethyl adipate or the monomethyl glutarate essentially free of glutaric anhydride and glutaric acid used is 2–50 moles per mole of the monomethyl ester of a $C_8$–$C_{11}$ dicarboxylic acid used.

5. A process according to claim 4, wherein the amount of the monomethyl adipate or the monomethyl glutarate essentially free of glutaric anhydride and glutaric acid used is 5–30 moles per mole of the monomethyl ester of a $C_8$–$C_{11}$ dicarboxylic acid used.

6. A process according to claim 1, wherein the electrolytic condensation is conducted under the conditions that the concentration of the mixture of acid esters consisting of monomethyl adipate and a monomethyl ester of a $C_8$–$C_{11}$ dicarboxylic acid is 10–50% by weight, the neutralization degree of said mixed acid with at least one base selected from hydroxides, carbonates, bicarbonates, methylates, and ethylates of potassium and of sodium is 2–50 mole;, the flow rate of electrolyte in the electrolytic cell is 1–4 m/sec, the space between electrodes is 0.5–3 mm, the current density is 5–40 A/dm$^2$, and the temperature of the electrolyte is 45°–65° C.

7. A process according to claim 1, wherein the alkali salts of the mixture of acid esters consisting of monomethyl adipate or monomethyl glutarate essentially free of glutaric anhydride and glutaric acid and a monomethyl ester of a $C_8$–$C_{11}$ dicarboxylic acid is recovered from the electrolyte and recycled to the electrolytic condensation reaction.

8. A process according to claim 7, wherein the alkali salts of the mixture of monomethyl adipate or monomethyl glutarate essentially free of glutaric anhydride and glutaric acid and a monomethyl ester of a $C_8$–$C_{11}$ dicarboxylic acid is recovered and recycled by removing methanol after addition of water to the electrolyte, separating the residual liquid into an oily layer substantially containing methyl esters of higher dibasic acids and an aqueous layer substantially containing the alkali metal salts, adding monomethyl adipate or monomethyl glutarate essentially free of glutaric anhydride and glutaric acid and the monomethyl ester of a $C_8$–$C_{11}$ dicarboxylic acid, and evaporating water off.

9. A process according to claim 7, wherein, the water concentration in the methanolic solution during the electrolytic condensation is 0.6–3.5% by weight; the amount of the alkali salts of the mixture of acid esters consisting of monomethyl adipate or monomethyl glutarate essentially free of glutaric anhydride and glutaric acid and a monomethyl ester of a $C_8$–$C_{11}$ dicarboxylic acid is at least 1% by weight based on the electrolyte and is not more than 3 parts by weight based on the water contained in the electrolyte; and the alkali salts of the mixture of acid esters, after removal of methanol from the electrolyte, are recovered and recycled as an aqueous layer containing essentially the alkali metal salts of said mixture of acid esters.

10. A process according to any of claims 1 and 9, wherein a part of the mixture of acid esters consisting of monomethyl adipate or monomethyl glutarate essentially free of glutaric anhydride and glutaric acid and a monomethyl ester of a $C_8$–$C_{11}$ dicarboxylic acid is charged at the start of electrolysis and the remainder part is continuously added during the electrolytic condensation.

* * * * *

UNITED STATES PATENT AND TRADEMARK OFFICE

CERTIFICATE OF CORRECTION

PATENT NO. : 4,525,251

DATED : June 25, 1985

INVENTOR(S) : KAZUNORI YAMATAKA ET AL

It is certified that error appears in the above-identified patent and that said Letters Patent is hereby corrected as shown below:

On the cover page, Item [30], delete

"May 28, 1981 [JP] Japan..... 56-80016

Jun. 4, 1981 [JP] Japan..... 56-85017".

Signed and Sealed this

*Twenty-fourth* Day of *December 1985*

[SEAL]

*Attest:*

DONALD J. QUIGG

*Attesting Officer*

*Commissioner of Patents and Trademarks*